US008008587B2

(12) United States Patent
Kapples et al.

(10) Patent No.: US 8,008,587 B2
(45) Date of Patent: Aug. 30, 2011

(54) CIRCUIT BREAKER CARRIER ASSEMBLY WITH SPRING GUIDE

(75) Inventors: Lawrence Joseph Kapples, Pittsburgh, PA (US); David Curtis Turner, Imperial, PA (US); Mark Allen McAfee, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 237 days.

(21) Appl. No.: 12/420,593

(22) Filed: Apr. 8, 2009

(65) Prior Publication Data

US 2010/0258415 A1 Oct. 14, 2010

(51) Int. Cl.
*H01H 1/22* (2006.01)

(52) U.S. Cl. ..... 200/244

(58) Field of Classification Search ..... 200/244
See application file for complete search history.

(56) References Cited

U.S. PATENT DOCUMENTS

| | | | | |
|---|---|---|---|---|
| 5,566,818 | A * | 10/1996 | Kuboyama et al. | 200/271 |
| 5,694,098 | A | 12/1997 | Mody et al. | |
| 6,005,206 | A | 12/1999 | Rakus et al. | |
| 2010/0258416 | A1 * | 10/2010 | Kapples et al. | 200/244 |

* cited by examiner

*Primary Examiner* — Edwin A. Leon
*Assistant Examiner* — Vanessa Girardi
(74) *Attorney, Agent, or Firm* — Martin J. Moran

(57) ABSTRACT

A spring guide is provided for a carrier assembly of an electrical switching apparatus such as, for example, a circuit breaker. The carrier assembly includes a carrier body, a plurality of movable contact arms pivotably coupled to the carrier body, and a plurality of contact springs. Each of the contact springs is disposed between a portion of the carrier body and a corresponding number of the movable contact arms. Each spring guide includes a guide member disposed between a corresponding one of the contact springs and the corresponding number of movable contact arms to maintains alignment therebetween. The guide member preferably includes a planar portion including a first side, which spans a pair of adjacent movable contact arms, and a second side, which includes a projection. The projection is disposed within the coils of the corresponding one of the contact springs.

19 Claims, 6 Drawing Sheets

CIRCUIT BREAKER CARRIER ASSEMBLY WITH SPRING GUIDE

CROSS-REFERENCE TO RELATED APPLICATION

This application is related to commonly assigned, concurrently filed:

U.S. patent application Ser. No. 12/420,597, filed Apr. 8, 2009, entitled "ELECTRICAL SWITCHING APPARATUS AND ADJUSTABLE CARRIER ASSEMBLY THEREFOR".

BACKGROUND

1. Field

The disclosed concept relates generally to electrical switching apparatus and, more particularly, to electrical switching apparatus, such as circuit breakers. The disclosed concept also relates to carrier assemblies for electrical switching apparatus. The disclosed concept further relates to spring guides for circuit breaker carrier assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

As shown in FIG. 1, the electrical contact assemblies of some circuit breakers include a movable contact assembly 1 having a plurality of movable contacts 3, which are movable into and out of electrical contact with corresponding stationary contacts (not shown). Specifically, the movable contacts 3 are disposed on movable contact arms or fingers 5, which are pivotably coupled to a carrier assembly 7 (see also FIGS. 2A and 2B). The carrier assembly 7 includes a plurality of contact springs 9, shown in FIGS. 2A and 2B, which are structured to bias the fingers 5 (FIG. 1) and corresponding movable contacts 3 (FIG. 1) disposed thereon against the stationary contacts (not shown) in order to provide and maintain contact pressure when the circuit breaker is closed, and to accommodate wear. The carrier assembly 7 also includes a plurality of blow off springs 11 (also sometimes referred to as cam springs) (best shown in the exploded view of FIG. 2B), which are structured to reduce circuit breaker fault clearing times. That is, the carrier assembly 7 is designed to be current-limiting such that the movable contacts 3 (FIG. 1) of the movable contact assembly 1 "blow off" (e.g., separate from) the corresponding stationary contacts (not shown) under relatively high current fault conditions.

Among other disadvantages, such carrier assembly designs include numerous parts and are relatively difficult to assemble. For example and without limitation, as shown in the example of FIGS. 2A and 2B, the carrier assembly 7 includes as many as 20 or more contact springs 9, which are difficult to assemble and difficult to properly align with the corresponding fingers 5 (FIG. 1) of the assembly carrier assembly 7. Improper alignment results in inconsistent spring force, and a lower than desired withstand rating for the circuit breaker. Such carrier assembly designs are also sensitive to dimensional variations among the various components of the carrier assembly 7 which, on one hand, can result in undesirably low blow off forces (e.g., nuisance blow where unintended electrical disconnection occurs) and, on the other hand, can contribute to undesirably high blow off forces potentially leading to higher than desired current being let through the circuit breaker and causing damage to the circuit breaker.

There is, therefore, room for improvement in electrical switching apparatus, such as circuit breakers, and in carrier assemblies and spring guides therefor.

SUMMARY

These needs and others are met by embodiments of the disclosed concept, which are directed to a spring guide for the carrier assembly of an electrical switching apparatus, such as a circuit breaker. Among other benefits, the spring guide is structured to cooperate with the contact springs and movable contact arms (also sometimes referred to as fingers) of the carrier assembly to improve the withstand rating of the circuit breaker.

As one aspect of the disclosed concept, a spring guide is provided for a carrier assembly. The carrier assembly includes a carrier body, a plurality of movable contact arms pivotably coupled to the carrier body, and a plurality of contact springs. Each of the contact springs is disposed between a portion of the carrier body and a corresponding number of the movable contact arms. The spring guide comprises: a guide member structured to maintain alignment between a corresponding one of the contact springs of the carrier assembly and the corresponding number of the movable contact arms.

The corresponding number of the movable contact arms may be at least two movable contact arms. The guide member may comprise a planar portion including a first side and a second side disposed opposite the first side. The first side of the planar portion may be structured to span the at least two movable contact arms, and the second side of the planar portion may be structured to engage the corresponding one of the contact springs.

As another aspect of the disclosed concept, a carrier assembly is provided for an electrical switching apparatus. The carrier assembly comprises: a carrier body; a plurality of movable contact arms pivotably coupled to the carrier body; a plurality of contact springs, each of the contact springs being disposed between a portion of the carrier body and a corresponding number of the movable contact arms; and at least one spring guide comprising: a guide member disposed between a corresponding one of the contact springs and the corresponding number of the movable contact arms. The at least one spring guide maintains alignment between the corresponding one of the contact springs and the corresponding number of the movable contact arms.

As a further aspect of the disclosed concept, an electrical switching apparatus comprises: a number of stationary contacts; and at least one carrier assembly comprising: a carrier body, a plurality of movable contact arms pivotably coupled to the carrier body, a plurality of movable contacts disposed on the movable contact arms, each of the movable contacts being movable into and out of electrical contact with a corresponding one of the number of stationary contacts, a plurality of contact springs, each of the contact springs being disposed between a portion of the carrier body and a corresponding number of the movable contact arms, and at least one spring guide comprising: a guide member disposed between a corresponding one of the contact springs and the corresponding number of the movable contact arms. The at least one spring guide maintains alignment between the corresponding one of the contact springs and the corresponding number of the movable contact arms.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
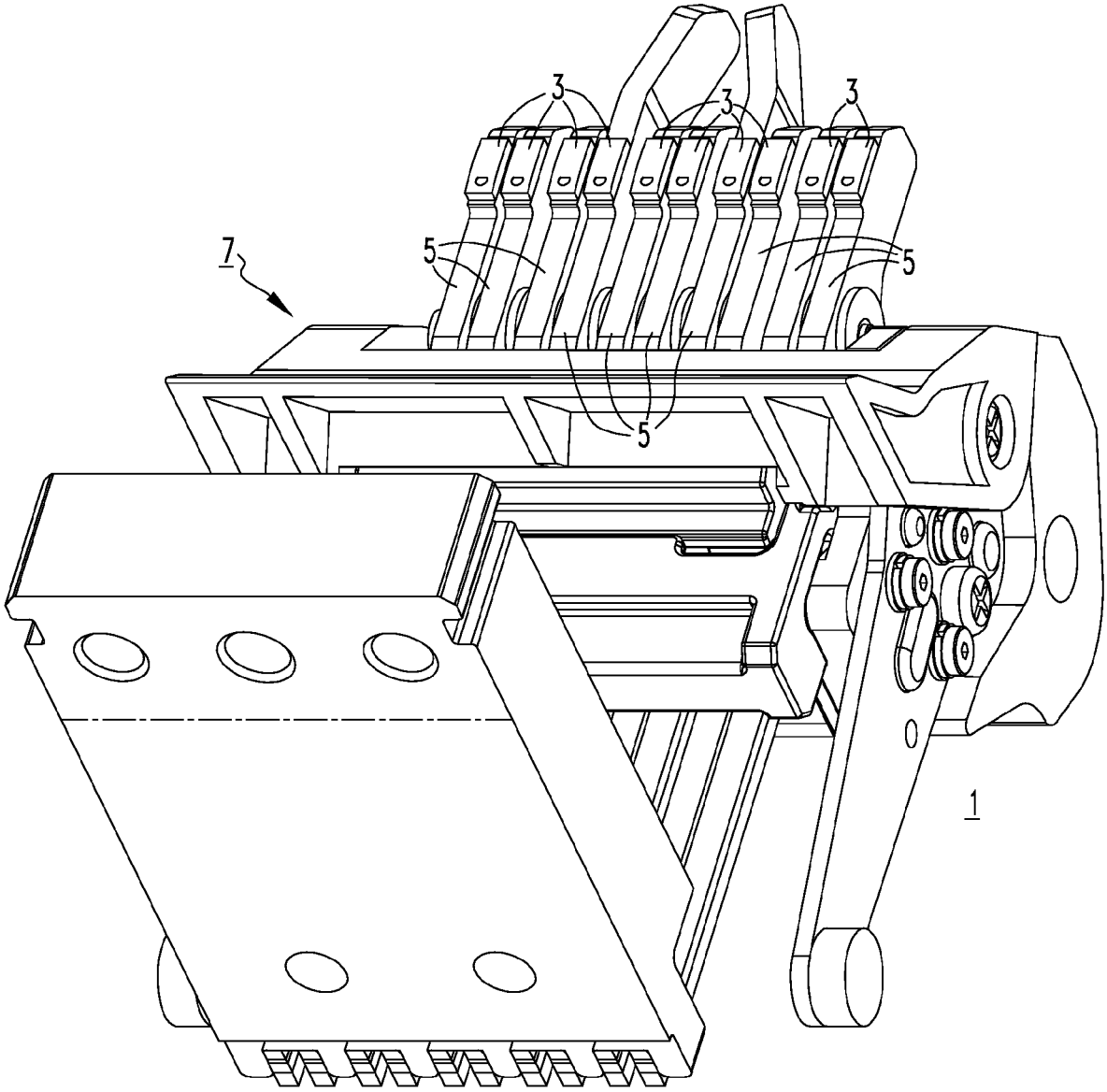
FIG.1 PRIOR ART
FIG. 1 is an isometric view of a movable contact assembly and carrier assembly therefor.

Directional phrases used herein, such as, for example, left, right, beneath, under and derivatives thereof, relate to the orientation of the elements shown in the drawings and are not limiting upon the claims unless expressly recited therein.

As employed herein, the term "blow off force" refers to the electromagnetic force that tends to open electrical contact between separable electrical contacts (e.g., stationary contacts; movable contacts). Under certain electrical fault conditions (e.g., without limitation, current overloads; short circuits; other fault conditions), an opposing bias force is surpassed by the blow off force, resulting in the movable contact(s) blowing off of the corresponding stationary contact(s) to break the flow of electric current therethrough.

The term "blow open force" means the same as the term "blow off force". For example, in switching apparatus incorporating current limiting contact structures, the separable contacts are commonly arranged to provide a particular length of conductor for providing reversely directed parallel current paths in parallel conductor members. As the magnitude of the current increases, the current generates electromagnetic forces which dynamically repel the conductor members. If one conductor member is fixed, the repelling magnetic force is directed upon the movable conductor member as a blow open force which drives the movable conductor member away from the fixed conductor member to separate the contacts. See, for example, U.S. Pat. No. 5,694,098.

As employed herein, the term "fastener" refers to any suitable connecting or tightening mechanism expressly including, but not limited to, screws (e.g., without limitation, set screws), bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
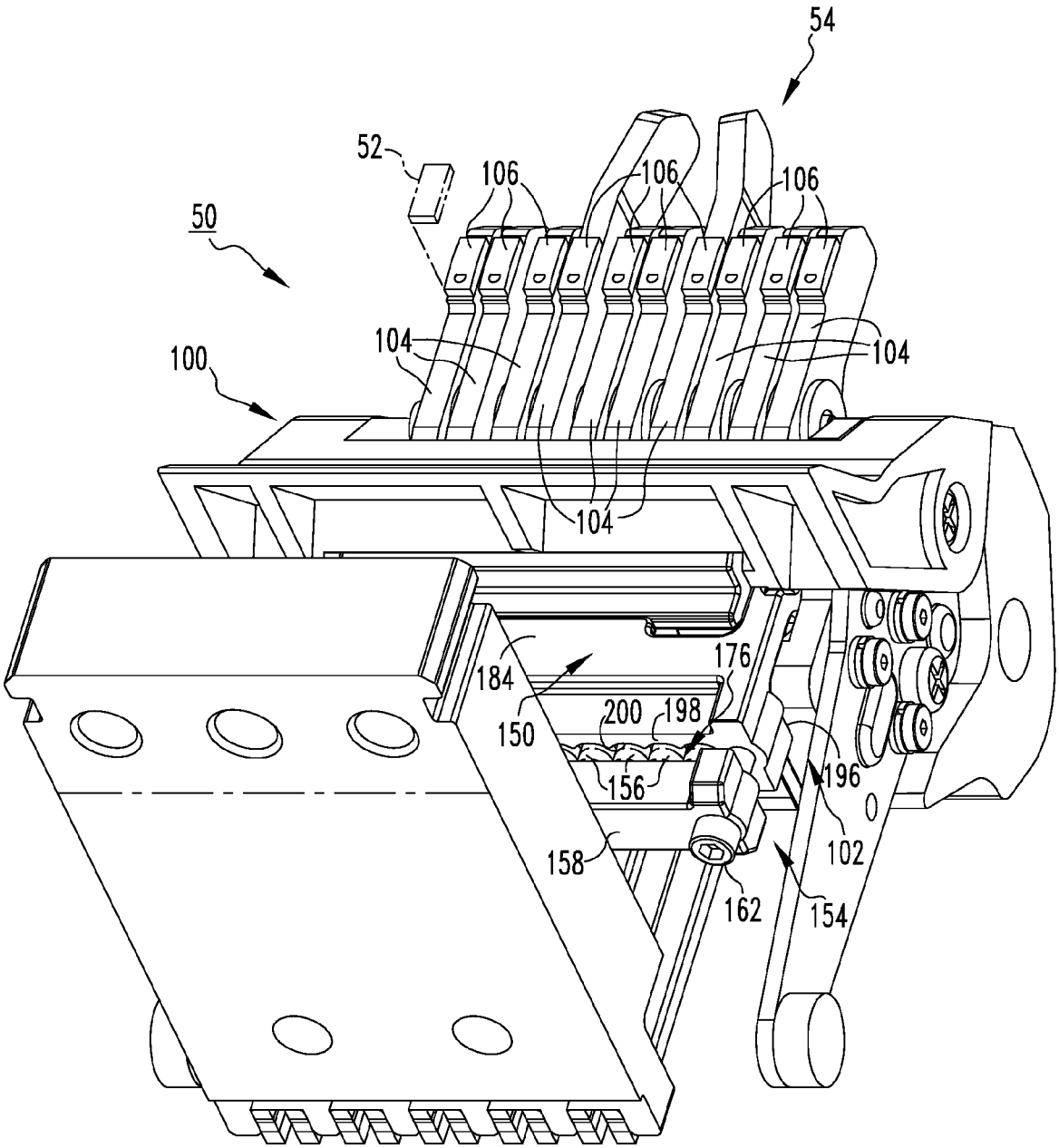
FIG. 3 is an isometric view of a carrier assembly, in accordance with embodiments of the disclosed concept.
Figure 4A:
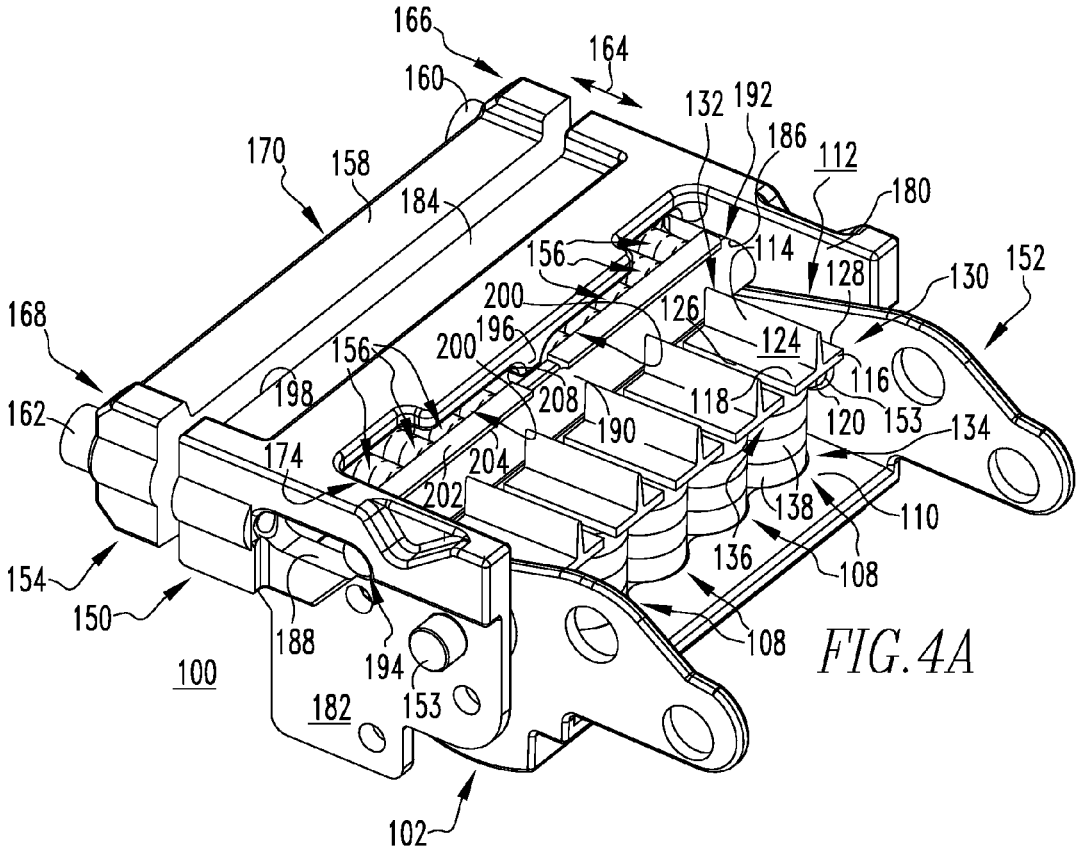
FIG. 4A is an isometric view of the carrier assembly of FIG. 3, also showing a plurality of spring guides therefor, in accordance with an embodiment of the disclosed concept.
Figure 4B:
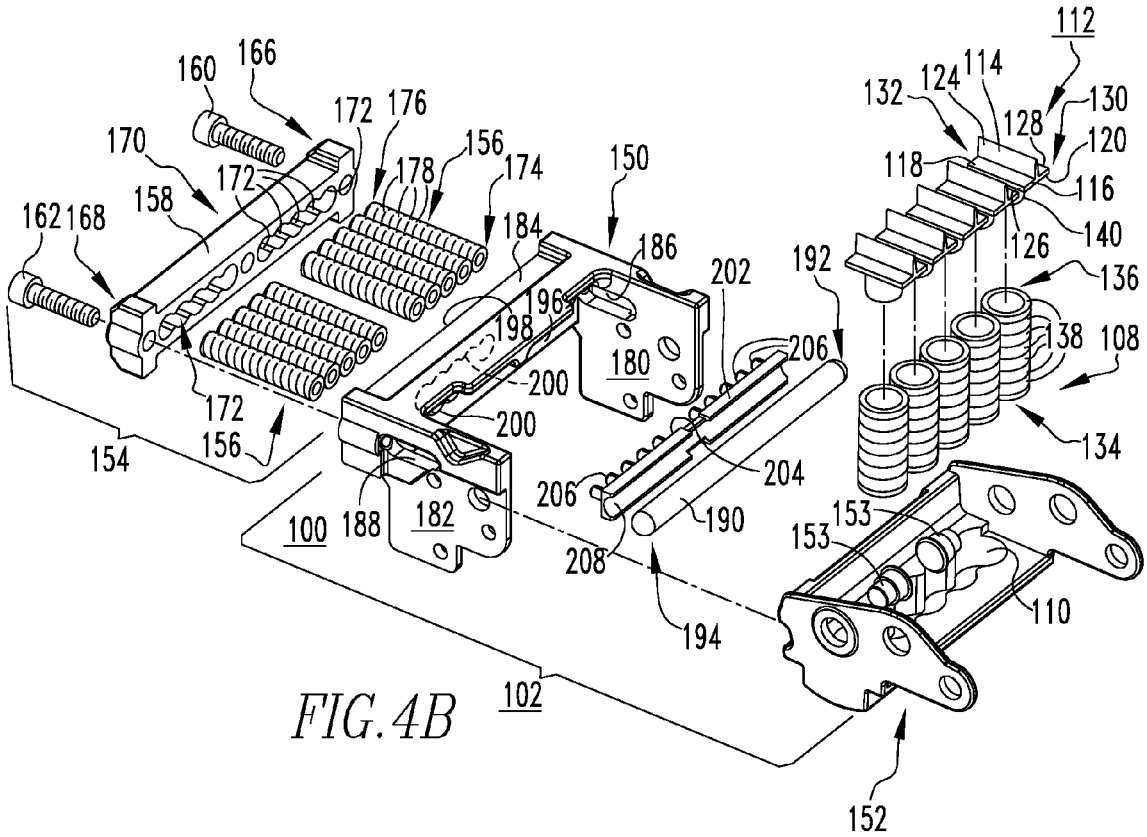
FIG. 4B is an exploded isometric view of the carrier assembly and spring guides therefor of FIG. 4A.

FIGS. 3, 4A and 4B show a carrier assembly 100 for an electrical switching apparatus such as, for example, a circuit breaker (indicated generally by reference 50 in FIG. 3), which includes a number of poles (one pole is generally indicated by reference 54 in FIG. 3) each having a number of stationary contacts 52 (one stationary contact 52 is shown in simplified form in phantom line drawing in FIG. 3). For economy of disclosure and ease of illustration, one carrier assembly 100 is shown and described herein, although it will be appreciated that the circuit breaker 50 (FIG. 3) could employ any known or suitable alternative number of carrier assemblies (e.g., 100). For example and without limitation, each pole (e.g., 54 (FIG. 3)) of the circuit breaker 50 (e.g., 50 (FIG. 3)) could include a corresponding carrier assembly (e.g., 100) such that, for example and without limitation, a three-pole circuit breaker would include three carrier assemblies 100, one for each pole.

Each carrier assembly 100 includes a carrier body 102, a plurality of movable contact arms 104 pivotably coupled to the carrier body 102, and a plurality of movable contacts 106 disposed on the movable contact arms 104, as shown in FIG. 3. Each of the movable contacts 106 is movable into (not shown) and out of (FIG. 3) electrical contact with a corresponding one of the stationary contacts 52 (shown in simplified form in phantom line drawing in FIG. 3), in a generally well known manner. For ease of illustration, the movable contact arms 104 are not shown in FIGS. 4A and 4B. Rather, the movable contact arms 104 (FIGS. 3 and 6) have been removed from FIGS. 4A and 4B to show underlying structures, such as the plurality of contact springs 108, which are disposed beneath the movable contact arms 104 (FIGS. 3 and 6).

Figure 5A:
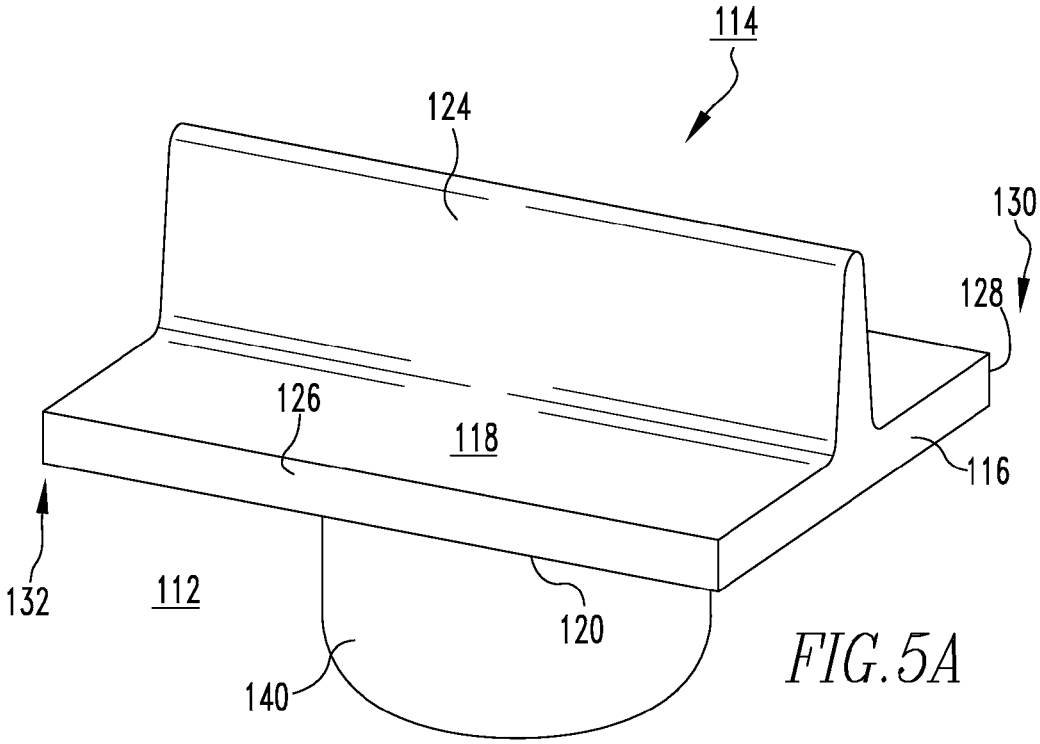
FIGS. 5A and 5B are isometric and end elevation views, respectively, of one of the spring guides of FIG. 4B.
Figure 5B:
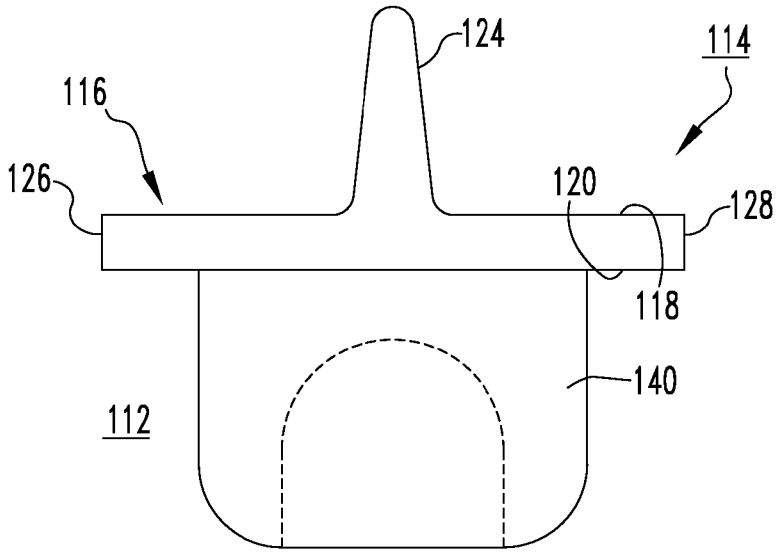
Figure 6:
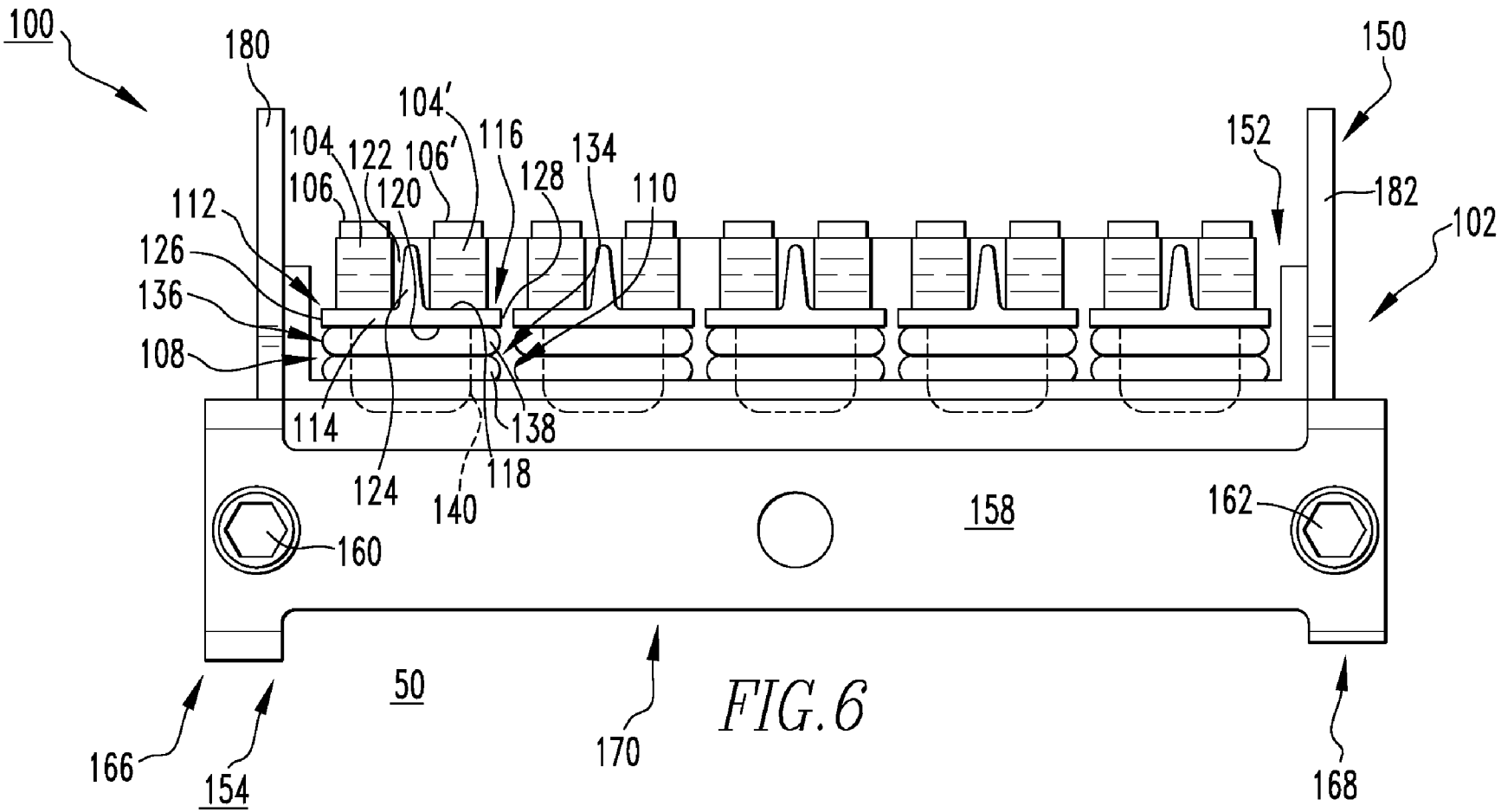
FIG. 6 is an end elevation view of the carrier assembly and spring guides therefor of FIG. 4A.

Each of the contact springs 108 is disposed between a portion 110 of the carrier body 102 and a corresponding number of the movable contact arms 104 (FIGS. 3 and 6). For example, as best shown in the end elevation view of FIG. 6, contact spring 108 is disposed between portion 110 of carrier body 102 and the adjacent pair of movable contact arms 104,104'. In the example of FIGS. 4A, 4B and 6, the carrier assembly includes five contact springs 108, each structured to bias a corresponding adjacent pair (see, for example, adjacent pair of movable contact arms 104,104' of FIG. 6) of the ten total movable contact arms 104 that are present (see FIGS. 3 and 6). It will, however, be appreciated that the carrier assembly 100 could include any known or suitable alternative number and/or configuration of contact springs 108, movable contact arms 104,104' (FIG. 6) and/or spring guides 112 (discussed hereinbelow with respect to FIGS. 4A-6), without departing from the scope of the disclosed concept. It will also be appreciated that, for ease of illustration, the features (e.g., first end 134; second end 136; coils 138) of only one contact spring 108 are labeled (see, for example, FIGS. 4A, 4B and 6). The other four contact springs 108 are substantially identical.

Continuing to refer to FIGS. 4A and 4B, as well as FIGS. 5A and 5B, it will be appreciated that each of the spring guides 112 includes a guide member 114 structured to be disposed between a corresponding one of the contact springs 108 and the corresponding adjacent pair of movable contact arms 104,104', as shown in FIG. 6. In this manner, the spring guide 112 maintains alignment between the contact spring 108 and the corresponding pair of adjacent movable contact arms 104,104' (FIG. 6). More specifically, the guide member 114 includes a planar portion 116 having first and second opposing sides 118,120. The first side 118 spans at least two of the movable contact arms 104 (see, for example, first side 118 of the planar portion 116 of guide member 114 of FIG. 6 spanning the pair of adjacent movable contact arms 104,104'). The second side 120 of the planar portion 116 engages the corresponding contact spring 108, as shown in FIG. 6.

As shown in FIG. 6, a protrusion 124, which extends outwardly from the first side 118 of the planar portion 116 of the guide member 114, is structured to be disposed in a gap 122 between the pair of adjacent movable contact arms 104,104'. Thus, the protrusion, which is preferably an elongated tab 124, functions to secure the spring guide 112 with respect to the movable contact arms 104,104' and, therefore, to maintain alignment between the movable contact arms 104,104' and the corresponding single contact spring 108. The example elongated tab 124 extends from about the first end 130 of the planar portion 116 of the guide member 114 to the second end 132, intermediate the first and second opposing edges 126, 128 of the guide member 114.

The relationship of the spring guide 112 with respect to the contact spring 108 and corresponding movable contact arms 104,104' is further achieved and maintained by a projection 140, which projects outwardly from the second side 120 of the planar portion 116 of the guide member 114. As shown in the example of FIG. 5A, the projection 140 preferably has a generally cylindrical shape, and engages (e.g., is disposed within) the contact spring 108, as shown in hidden line drawing in FIG. 6. Specifically, each of the contact springs 108 (FIGS. 4A, 4B and 6) includes a first end 134, a second end 136 disposed opposite and distal from the first end 134, and a plurality of coils 138 extending therebetween. As shown in hidden line drawing in FIG. 6, the generally cylindrical projection 140 extends into the coil 138 of the corresponding contact spring 108 such that, when the carrier assembly 100 is assembled as shown, the first end 134 of the contact spring 108 engages the aforementioned portion 110 of the carrier body 102, and the second end 136 of the contact spring 108 abuts the second side 120 of the planar portion 116 of the guide member 114. It will, however, be appreciated that features (e.g., without limitation, planar portion 116; protrusion 124; projection 140) of the guide member 114 could have any known or suitable alternative configuration (not shown) for establishing and maintaining the desired orientation (e.g., alignment) between each contact spring 108 and the corresponding plurality (e.g., without limitation, adjacent pair) of movable contact arms 104,104' (FIG. 6), without departing from the scope of the disclosed concept.

Figure 2A:
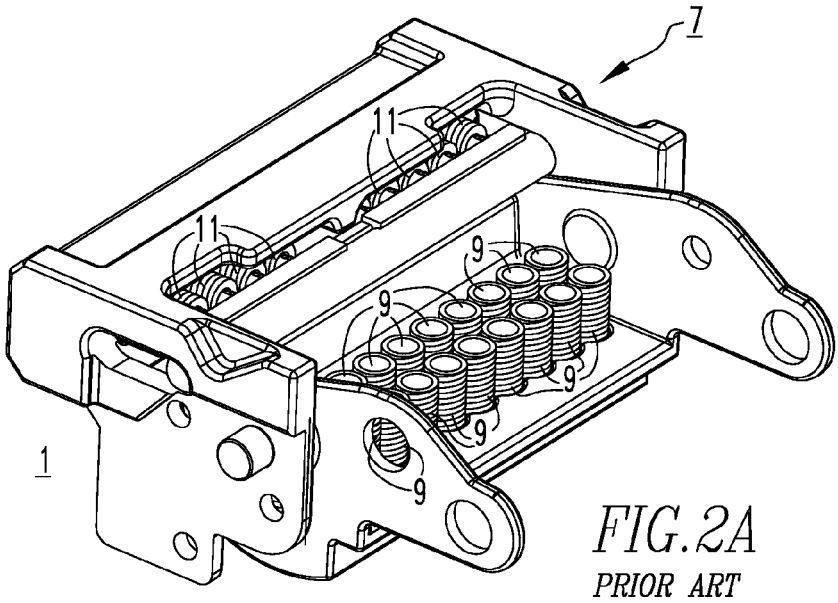
FIG.2A PRIOR ART
FIG. 2A is an isometric view of the carrier assembly of FIG. 1.
Figure 2B:
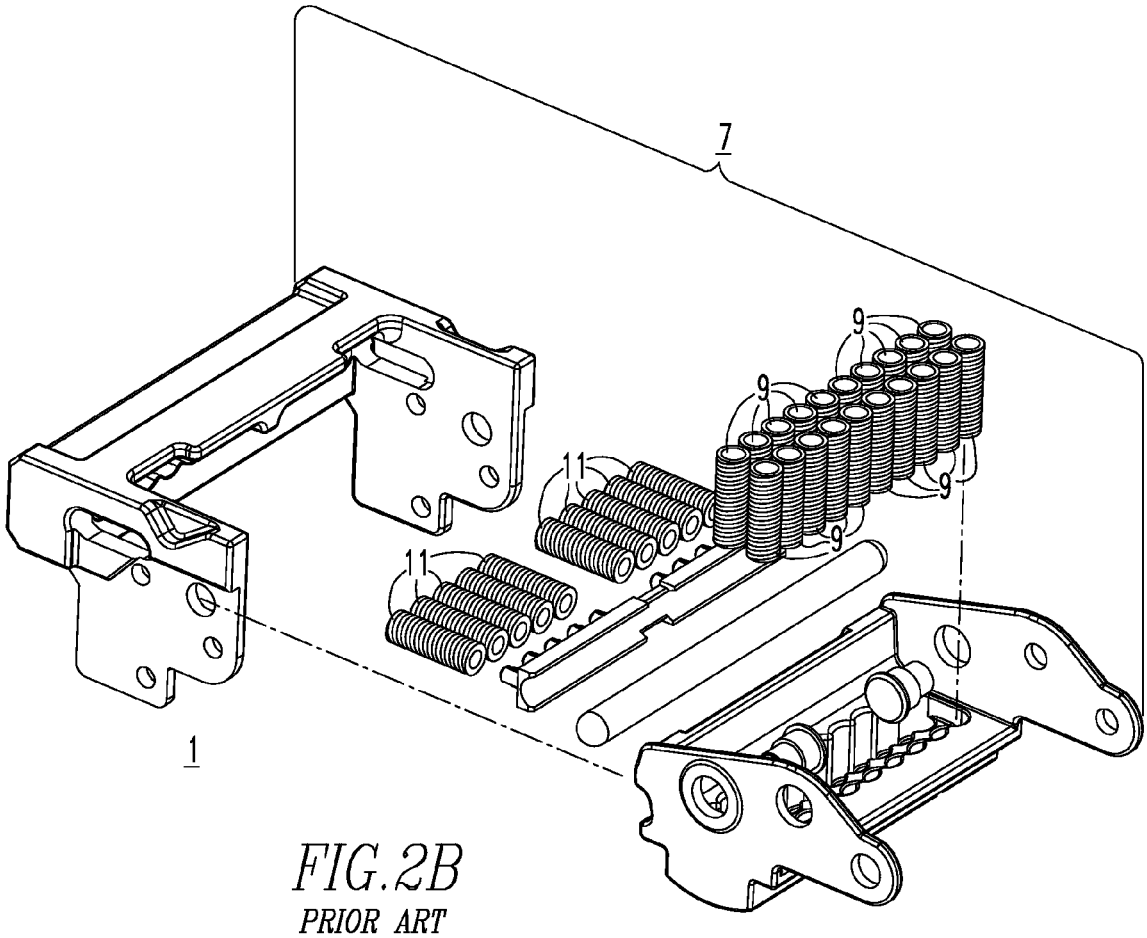
FIG.2B PRIOR ART
FIG. 2B is an exploded isometric view of the carrier assembly of FIG. 2A.

Accordingly, it will be appreciated that the disclosed spring guide 112 not only functions to facilitate the relatively quick, easy and correct assembly of the carrier assembly 100 (FIGS. 3, 4A, 4B and 6), but also enables a lesser number (e.g., without limitation five) of contact springs 108 to be employed in comparison with known carrier assemblies (see, for example, carrier assembly 7 of FIGS. 2A and 2B, which employs twenty contact springs 9). This reduced number of contact springs 108 further simplifies the assembly process and alleviates potential misalignment issues associated therewith. In addition, larger springs (compare, for example, contact springs 108 of FIGS. 4A, 4B and 6 to the relatively smaller contact springs 9 of FIGS. 2A and 2B) to be employed, which provides the further benefit of allowing for substantial freedom in the design of the springs to be used. This, in turn, permits enhanced spring forces to be achieved with less stress on the springs 108 and/or the components (e.g., without limitation, carrier body 102; movable contact arms 104,104') on which the springs 108 act. More strict acceptance criteria with respect to acceptable contact spring force can, be achieved, which, therefore, enables the circuit breaker (indicated generally by reference 50 in FIG. 3) to achieve relatively high withstand ratings (e.g., without limitation, up to about 50 kA or more for a three-pole circuit breaker; up to about 85 kA or more for a six-pole circuit breaker).

In addition to the aforementioned spring guides 112, the carrier assembly 100 is preferably adjustable and, therefore, overcomes disadvantages (e.g., without limitation, difficult assembly; improper alignment; blow off force out of specification) associated with known carrier assemblies (see, for example, carrier assembly 7 of FIGS. 1, 2A and 2B), which are not adjustable. Specifically, to ensure that the circuit breaker (indicated generally by reference 50 in FIG. 3) will function properly in service, the carrier assembly 100 (FIGS. 3, 4A, 4B and 6) is tested to verify that the required blow off force is within predetermined upper and lower limits. Accordingly, it is desirable to reduce or minimize the number of rejections in order to increase or maximize production yield of carrier assemblies 100 (FIGS. 3, 4A, 4B and 6), particularly in view of its relatively high cost.

The adjustable nature of the disclosed carrier assembly 100 enables it to be relatively quickly and easily assembled and adjusted to be within requisite or desired engineering specification limits (e.g., without limitation, a predetermined bias force for opposing the blow off force). For example and without limitation, the production yield of some conventional carrier assemblies (e.g., without limitation, carrier assembly 7 of FIGS. 1, 2A and 2B) is about 70 percent to about 80 percent, whereas the adjustable carrier assembly 100 substantially improves production yield to at or about 100 percent.

The carrier body 102 of the adjustable carrier assembly 100 preferably includes a first carrier member 150 and a second carrier member 152, which is pivotably coupled to the first carrier member 150 by pin members 153, as shown in FIG. 4A (see also FIG. 4B). An adjustment mechanism 154 is coupled to the carrier body 102, and a plurality of springs 156, sometimes referred to as blow off springs or cam springs, are disposed between the adjustment mechanism 154 and the second carrier member 152. The springs 156 apply a bias force (e.g., opposing the blow off force) on the second carrier member 152. As described hereinbelow, the adjustment mechanism 154 is adjustable with respect to the carrier body 102 to adjust the bias force.

In the example shown and described herein, the adjustment mechanism 154 includes an elongated member 158 and a number of fasteners, such as the first and second screws 160,162 shown in FIGS. 4A, 4B and 6. The first fastener 160 fastens the first end 166 of the elongated member 158 to the first carrier member 150, and the second fastener 162 fastens the second end 168 of the elongated member 158 to the first carrier member 150, as shown in FIG. 4A. As indicated generally by arrow 164 of FIG. 4A, the fasteners 160,162 can be tightened to move the elongated member 158 of the adjustment mechanism 154 toward (e.g., to the right from the perspective of FIG. 4A) the first carrier member 150, thereby increasing the aforementioned bias force, and they can be loosened to move the elongated member 158 away from (e.g., to the left from the perspective of FIG. 4A) the first carrier member 150, thereby decreasing the bias force.

As shown in FIG. 4B, the intermediate portion 170 of the elongated member 158, between the first and second ends 166,168 thereof, includes at least one recess 172. In the example of FIG. 4B, such intermediate portion 170 includes ten receptacles 172, each shaped to receive an end (e.g., second end 176) of a corresponding one of the ten blow off springs 156. For ease of illustration, the features of only one blow off spring 156 are labeled, although it will be appreciated that the remaining blow off springs 156 are substantially identical. Specifically, each blow off spring 156 includes a first end 174, the second end 176 disposed opposite and distal from the first end 174, and a plurality of coils 178 extending therebetween. The first end 174 of each spring 156 is disposed proximate the second carrier member 152 of the carrier body 102, and the second end 176 is disposed in the corresponding receptacle 172 of intermediate portion 170 of the adjustment mechanism elongated member 158. It will, however, be appreciated that any known or suitable alternative number and/or configuration of blow off springs 156 and/or recesses (e.g., 172) therefor, could be employed without departing from the scope of the disclosed concept.

Continuing to refer to FIG. 4B, the first carrier member 150 of the example carrier body 102 includes first and second opposing sidewalls 180,182. A body portion 184 extends between the sidewalls 180,182. The second carrier member 152 is pivotably coupled to the first and second sidewalls 180,182 by the aforementioned pin members 153 and is disposed therebetween, as shown in FIG. 4A. The first sidewall 180 includes a first slot 186 and the second sidewall 182 includes a second slot 188. The carrier body 102 further includes a rod 190 having a first end 192 movably disposed within the first slot 186 of the first sidewall 180, and a second end 194 movably disposed within the second slot 188 of the second sidewall 182. Thus, the blow off springs 156 function to bias the rod 190 against the second carrier member 152 of the carrier body 102 to provide the desired mechanical blow off force, which can advantageously be adjusted.

More specifically, the blow off springs 156 engage an elongated spring retainer 202 which, in turn, cooperates with the rod 190 to engage and bias the second carrier member 152 of the adjustable carrier assembly 100. Accordingly, when the adjustable carrier assembly 100 is assembled, the first end 174 of each of the blow off springs 156 cooperates with the second carrier member 152 on a first side 196 of the body portion 184 of the first carrier member 150, and the second end 176 of each blow off spring 156 cooperates with the adjustment mechanism 154 on a second side 198 of the first carrier member body portion 184. Thus, each of the springs 156 extends through a corresponding aperture 200 (partially shown in hidden line drawing in FIG. 4B; see also FIGS. 3 and 4A) of the body portion 184 of the first carrier member 150. It will, however, be appreciated that the first carrier member 150 of the carrier body 102 could have any known or suitable alternative number and/or configuration of apertures (e.g., 200) for suitably receiving the coils 178 of blow off springs 156 therethrough.

The aforementioned elongated spring retainer 202 of the carrier body 102, which is best shown in the exploded view of FIG. 4B, includes a first side 204 having a plurality of projections 206 extending outwardly therefrom, and a second side 208 having an arcuate shape. The arcuate shape of the second side 208 of the elongated spring retainer 202 engages the rod 190, as shown in FIG. 4A, and as previously described hereinabove. Each of the projections 206 of the first side 204 of the elongated spring retainer 202 is structured to be disposed within a number of the coils 178 of a corresponding one of the blow off springs 156, in order to retain the first end 174 thereof.

Accordingly, the disclosed carrier assembly 100 (FIGS. 3, 4A, 4B and 6) is advantageously adjustable, thereby enabling it to be relatively quickly and easily assembled and adjusted to be within requisite or desired engineering specification limits (e.g., without limitation, for a bias force opposing a blow off force). This, in turn, greatly reduces the number of carrier assemblies that would otherwise be rejected and discarded if they did not meet specification and had no ability to be adjusted to do so. Thus, among other benefits, production yield of the carrier assembly 100 is increased. Additionally, the adjustable nature of the carrier assembly 100 enables it to be fine-tuned to within a specific desired operating range, and substantially eliminates excessively high initial spring forces that can occur during assembly and disadvantageously induce stress fractures in critical operating components (e.g., without limitation, carrier body 102).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A spring guide for a carrier assembly including a carrier body, a plurality of movable contact arms pivotably coupled to said carrier body, and a plurality of contact springs, each of said contact springs being disposed between a portion of said carrier body and a corresponding number of said movable contact arms, said spring guide comprising:

a guide member structured to maintain alignment between a corresponding one of said contact springs of said carrier assembly and said corresponding number of said movable contact arms, said guide member comprising a first side and a second side disposed opposite the first side, the first side being structured to engage at least one of said corresponding number of movable contact arms, the second side being structured to cooperate with said corresponding one of said contact springs, wherein said guide member is structured to be biased by said corresponding one of said contact springs, thereby pivotably biasing said corresponding number of movable contact arms with respect to said carrier body.

2. A spring guide for a carrier assembly including a carrier body, a plurality of movable contact arms pivotably coupled to said carrier body, and a plurality of contact springs, each of said contact springs being disposed between a portion of said carrier body and a corresponding number of said movable contact arms, said spring guide comprising:

a guide member structured to maintain alignment between a corresponding one of said contact springs of said carrier assembly and said corresponding number of said movable contact arms, wherein said corresponding number of said movable contact arms is at least two movable contact arms; wherein said guide member comprises a planar portion including a first side and a second side disposed opposite the first side; wherein the first side of the planar portion is structured to span said at least two movable contact arms; and wherein the second side of the planar portion is structured to engage said corresponding one of said contact springs.

3. The spring guide of claim 2 wherein said at least two movable contact arms is a pair of adjacent movable contact arms; wherein said pair of adjacent movable contact arms are separated by a gap; wherein said guide member further comprises a protrusion; wherein said protrusion extends outwardly from the first side of the planar portion of said guide member; and wherein said protrusion is structured to be disposed in the gap between said pair of adjacent movable contact arms.

4. The spring guide of claim 3 wherein the planar portion of said guide member includes a first edge, a second edge disposed opposite and distal from the first edge, a first end and a second end disposed opposite and distal from the first end; wherein said protrusion is an elongated tab; wherein said elongated tab extends from the first end to the second end; and wherein said elongated tab is disposed intermediate the first edge and the second edge.

5. The spring guide of claim 2 wherein said corresponding one of said contact springs includes a first end structured to engage said portion of said carrier body, a second end disposed opposite and distal from the first end of said corresponding one of said contact springs, and a plurality coils extending therebetween; wherein said guide member further comprises a projection projecting outwardly from the second side of the planar portion of said guide member; and wherein said projection is structured to be disposed within said coils of said corresponding one of said contact springs.

6. The spring guide of claim 5 wherein said projection has a generally cylindrical shape; wherein said projection is structured to extend into said coils of said corresponding one of said contact springs; and wherein, when said projection is disposed with said coils of said corresponding one of said contact springs, the second side of the planar portion of said guide member abuts the second end of said corresponding one of said contact springs.

7. A carrier assembly for an electrical switching apparatus, said carrier assembly comprising:

a carrier body;

a plurality of movable contact arms pivotably coupled to said carrier body;

a plurality of contact springs, each of said contact springs being disposed between a portion of said carrier body and a corresponding number of said movable contact arms; and at least one spring guide comprising:

a guide member disposed between a corresponding one of said contact springs and said corresponding number of said movable contact arms, said guide member comprising a first side and a second side disposed opposite the first side, the first side engaging at least one of said corresponding number of movable contact arms, the second side cooperating with said corresponding one of said contact springs, wherein said at least one spring guide maintains alignment between said corresponding one of said contact springs and said corresponding number of said movable contact arms, and wherein said corresponding one of said contact springs biases said guide member, thereby pivotably biasing said corresponding number of movable contact arms with respect to said carrier body.

8. A carrier assembly for an electrical switching apparatus, said carrier assembly comprising:

a carrier body;

a plurality of movable contact arms pivotably coupled to said carrier body;

a plurality of contact springs, each of said contact springs being disposed between a portion of said carrier body and a corresponding number of said movable contact arms; and at least one spring guide comprising:

a guide member disposed between a corresponding one of said contact springs and said corresponding number of said movable contact arms, wherein said at least one spring guide maintains alignment between said corresponding one of said contact springs and said corresponding number of said movable contact arms, and wherein said corresponding number of said movable contact arms is at least two movable contact arms; wherein said guide member of said at least one spring guide comprises a planar portion including a first side and a second side disposed opposite the first side; wherein the first side of the planar portion of said guide member spans said at least two movable contact arms; and wherein the second side of the planar portion of said guide member engages said corresponding one of said contact springs.

9. The carrier assembly of claim 8 wherein said at least two movable contact arms is a pair of adjacent movable contact arms; wherein said pair of adjacent movable contact arms are separated by a gap; wherein said guide member of said at least one spring guide further comprises a protrusion; wherein said protrusion extends outwardly from the first side of the planar portion of said guide member; and wherein said protrusion is disposed in the gap between said pair of adjacent movable contact arms.

10. The carrier assembly of claim 8 wherein said corresponding one of said contact springs includes a first end, a second end disposed opposite and distal from the first end of said corresponding one of said contact springs, and a plurality coils extending therebetween; wherein the first end of said corresponding one of said contact springs engages said portion of said carrier body; wherein said guide member of said at least one spring guide further comprises a projection projecting outwardly from the second side of the planar portion of said guide member; and wherein said projection is disposed within said coils of said corresponding one of said contact springs.

11. The carrier assembly of claim 8 wherein said at least one spring guide is a plurality of spring guides; wherein the first side of the planar portion of said guide member of each of said spring guides cooperates with a corresponding pair of adjacent movable contact arms; and wherein the second side of the planar portion of said guide member of each of said spring guides engages a single corresponding one of said contact springs, in order that each of said contact springs biases two of said movable contact arms.

12. The carrier assembly of claim 11 wherein said plurality of contact springs is five contact springs; wherein said plurality of movable contact arms is ten movable contact arms; wherein said plurality of spring guides is five spring guides; and wherein each of said five spring guides is coupled to a corresponding one of said five contact springs.

13. An electrical switching apparatus comprising:

a number of stationary contacts; and at least one carrier assembly comprising:

a carrier body, a plurality of movable contact arms pivotably coupled to said carrier body, a plurality of movable contacts disposed on said movable contact arms, each of said movable contacts being movable into and out of electrical contact with a corresponding one of said number of stationary contacts, a plurality of contact springs, each of said contact springs being disposed between a portion of said carrier body and a corresponding number of said movable contact arms, and at least one spring guide comprising:

a guide member disposed between a corresponding one of said contact springs and said corresponding number of said movable contact arms, said guide member comprising a first side and a second side disposed opposite the first side, the first side engaging at least one of said corresponding number of movable contact arms, the second side cooperating with said corresponding one of said contact springs, wherein said at least one spring guide maintains alignment between said corresponding one of said contact springs and said corresponding number of said movable contact arms, and wherein said corresponding one of said contact springs biases said guide member, thereby pivotably biasing said corresponding number of movable contact arms with respect to said carrier body.

14. An electrical switching apparatus comprising:

a number of stationary contacts; and at least one carrier assembly comprising:

a carrier body, a plurality of movable contact arms pivotably coupled to said carrier body, a plurality of movable contacts disposed on said movable contact arms, each of said movable contacts being movable into and out of electrical contact with a corresponding one of said number of stationary contacts, a plurality of contact springs, each of said contact springs being disposed between a portion of said carrier body and a corresponding number of said movable contact arms, and at least one spring guide comprising:

a guide member disposed between a corresponding one of said contact springs and said corresponding number of said movable contact arms, wherein said at least one spring guide maintains alignment between said corresponding one of said contact springs and said corresponding number of said movable contact arms, and wherein said corresponding number of said movable contact arms of said at least one carrier assembly is at least two movable contact arms; wherein said guide member of said at least one spring guide comprises a planar portion including a first side and a second side disposed opposite the first side; wherein the first side of the planar portion of said guide member spans said at least two movable contact arms; and wherein the second side of the planar portion of said guide member engages said corresponding one of said contact springs.

15. The electrical switching apparatus of claim 14 wherein said at least two movable contact arms of said at least one carrier assembly is a pair of adjacent movable contact arms; wherein said pair of adjacent movable contact arms are separated by a gap; wherein said guide member of said at least one spring guide further comprises a protrusion; wherein said protrusion extends outwardly from the first side of the planar portion of said guide member; and wherein said protrusion is disposed in the gap between said pair of adjacent movable contact arms.

16. The electrical switching apparatus of claim 14 wherein said corresponding one of said contact springs of said carrier assembly includes a first end, a second end disposed opposite and distal from the first end of said corresponding one of said contact springs, and a plurality coils extending therebetween; wherein the first end of said corresponding one of said contact springs engages said portion of said carrier body; wherein said guide member of said at least one spring guide further comprises a projection projecting outwardly from the second side of the planar portion of said guide member; and wherein said projection is disposed within said coils of said corresponding one of said contact springs.

17. The electrical switching apparatus of claim 14 wherein said at least one spring guide of said at least one carrier assembly is a plurality of spring guides; wherein the first side of the planar portion of said guide member of each of said spring guides cooperates with a corresponding pair of adjacent movable contact arms; and wherein the second side of the planar portion of said guide member of each of said spring guides engages a single corresponding one of said contact springs, in order that each of said contact springs biases two of said movable contact arms.

18. The electrical switching apparatus of claim 17 wherein said plurality of contact springs of said at least one carrier assembly is five contact springs; wherein said plurality of movable contact arms of said at least one carrier assembly is ten movable contact arms; wherein said plurality of spring guides of said at least one carrier assembly is five spring guides; and wherein each of said five spring guides is coupled to a corresponding one of said five contact springs.

19. The electrical switching apparatus of claim 14 wherein said electrical switching apparatus is a circuit breaker; wherein said circuit breaker includes a number of poles; and wherein said at least one carrier assembly is a single carrier assembly for each of the poles of said circuit breaker.

* * * * *